US011167561B2

(12) United States Patent
Wang

(10) Patent No.: US 11,167,561 B2
(45) Date of Patent: Nov. 9, 2021

(54) LIQUID JETTING HEAD

(71) Applicant: BROTHER KOGYO KABUSHIKI KAISHA, Nagoya (JP)

(72) Inventor: Rui Wang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/077,277

(22) Filed: Oct. 22, 2020

(65) Prior Publication Data

US 2021/0155006 A1 May 27, 2021

(30) Foreign Application Priority Data

Nov. 26, 2019 (JP) ..... JP2019-213407

(51) Int. Cl.
*B41J 2/175* (2006.01)
*B41J 2/14* (2006.01)

(52) U.S. Cl.
CPC ..... *B41J 2/17596* (2013.01); *B41J 2/14233* (2013.01); *B41J 2002/14419* (2013.01); *B41J 2002/14467* (2013.01)

(58) Field of Classification Search
CPC .. B41J 2/17596; B41J 2/1433; B41J 2/14201; B41J 2002/14419; B41J 2/14145
USPC ..... 347/20, 54, 68, 84, 85, 89
See application file for complete search history.

(56) References Cited

U.S. PATENT DOCUMENTS 8,820,899 B2 * 9/2014 Hoisington ..... B41J 2/14 347/84
10,549,539 B2 * 2/2020 Katayama ..... B41J 2/14209
10,583,657 B2 * 3/2020 Sugiura ..... B41J 2/17563
2017/0217176 A1 8/2017 Sato et al.
2017/0217197 A1 8/2017 Kanegae et al.
2017/0217199 A1 8/2017 Yamagishi et al.

FOREIGN PATENT DOCUMENTS

JP 2017-202677 A 11/2017

* cited by examiner

*Primary Examiner* — An H Do
(74) *Attorney, Agent, or Firm* — Merchant & Gould P.C.

(57) ABSTRACT

There is provided a liquid jetting head including: a supply manifold configured to define a first circulation channel through which a liquid in the supply manifold circulates; descenders that communicate with the supply manifold, and which is configured to guide the liquid to nozzles, respectively; and a second circulation channel configured to guide the liquid not discharged from the nozzles to the supply manifold. The second circulation channel includes a return manifold that extends to communicate with the descenders, and a return channel that communicates with the return manifold and communicates with the supply manifold via a return port. A first end of the first circulation channel in the supply manifold is an outflow port and a second end of the first circulation channel in the supply manifold is an inflow port. In the supply manifold, the return port is closer to the inflow port than to the outflow port.

7 Claims, 5 Drawing Sheets

LIQUID JETTING HEAD

CROSS REFERENCE TO RELATED APPLICATION

The present application claims priority from Japanese Patent Application No. 2019-213407 filed on Nov. 26, 2019, the disclosure of which is incorporated herein by reference in its entirety.

BACKGROUND

The present disclosure relates to a liquid jetting head provided for a liquid discharge apparatus configured to discharge liquid such as ink.

As a liquid discharge apparatus configured to discharge liquid such as ink, for example, an ink-jet type printer is conventionally used. The liquid discharge apparatus can form an image on a medium, such as a recording sheet, by discharging ink from a liquid discharge head on the medium. As the liquid discharge head, for example, there is known a configuration in which liquid circulates through a supply channel (manifold) from which the liquid is supplied to liquid discharge channels, like a liquid jetting unit (liquid jetting head) disclosed in Japanese Patent Application Laid-open No. 2017-202677.

The liquid jetting unit disclosed in Japanese Patent Application Laid-open No. 2017-202677 has a vertical space in which ink is stored temporarily. An outflow port of the vertical space communicates with an inflow port of a ceiling surface of a common liquid chamber (manifold). The common liquid chamber has openings. The openings communicate with pressure chambers. Each pressure chamber communicates with a nozzle. The ceiling surface of the common liquid chamber is also formed having a discharge port different from the inflow port. The discharge port communicates with a discharge path, and the discharge path communicates with the vertical space.

Ink is supplied from the vertical space to the common liquid chamber. Ink is supplied from the common liquid chamber to each pressure chamber via the opening. Ink is jetted from the nozzle due to pressure variation caused by a piezoelectric element. Ink supplied to the common liquid chamber flows out into the vertical space for circulation from the discharge port via the discharge path. The ceiling surface of the common liquid chamber is an inclined surface in which a portion close to the discharge port is higher than a portion close to the inflow port. Thus, if air bubbles are mixed in with ink, the air bubbles go up due to buoyancy and are guide to the discharge port of the common liquid chamber. Since the discharge path communicates with a gas permeable film and a defoaming space (bubble removing space) for removing air bubbles, the air bubbles in the common liquid chamber are efficiently discharged by the inclined ceiling surface.

SUMMARY

When a temperature of liquid such as ink (liquid temperature) varies, the liquid jetting head may have deterioration in liquid jetting performance, jetting failure, or the like. Thus, it is desirable to make the liquid temperature especially in the vicinity of the nozzle as equal (uniform) as possible.

In a configuration in which ink circulates through a supply path (manifold) like the configuration described in Japanese Patent Application Laid-open No. 2017-202677, ink temperature (liquid temperature) can be equalized in the supply path. The ink temperature in the vicinity of the nozzle, however, can not be equalized satisfactorily. Especially, since the piezoelectric element generates heat at the time of driving, an increase in ink temperature due to the driving heat of the piezoelectric element is required to be equalized quickly.

The present disclosure is made to solve the above problem, and an object of the present disclosure is to provide a liquid jetting head having a configuration in which liquid is jetted from a nozzle while being circulated and being capable of satisfactorily equalizing or uniformizing a temperature of the liquid in the vicinity of the nozzle.

In order to solve the above problem, a liquid jetting head according to the present disclosure includes:

a supply manifold configured to define a first circulation channel through which a liquid in the supply manifold circulates;

a plurality of descenders that communicate with the supply manifold, and which is configured to guide the liquid from the supply manifold to a plurality of nozzles arranged in a first direction, respectively; and a second circulation channel configured to guide the liquid not discharged from the nozzles to the supply manifold, wherein the second circulation channel includes a return manifold that extends in the first direction to communicate with the plurality of descenders, and a return channel that communicates with an end of the return manifold and communicates with the supply manifold via a return port, a first end, in the first direction, of the first circulation channel in the supply manifold is an outflow port via which the liquid flows out of the supply manifold, and a second end, in the first direction, of the first circulation channel in the supply manifold is an inflow port via which the liquid flows into the supply manifold, and in the supply manifold, the return port is closer to the inflow port than to the outflow port.

The above configuration includes the first circulation channel through which the liquid in the supply manifold circulates and the second circulation channel through which the liquid in the vicinity of the nozzles is circulated to (returns to) the supply manifold. A position (return port) where the liquid enters the supply manifold from the second circulation channel is closer to a position (inflow port) where the liquid flowing from an ink cartridge (or ink tank) or the like flows into the supply manifold than to a position (outflow port) where the liquid flows out through the first circulation channel from the supply manifold. In this configuration, liquid circulates so that a circulation direction of liquid in the supply manifold (flowing direction of liquid in the first circulation channel) is opposite to a circulation direction of liquid from the vicinity of the nozzles (flowing direction of liquid in the second circulation channel).

When seeing the entire liquid jetting head, the circulation direction of the first circulation channel is opposite to the circulation direction of the second circulation channel. When seeing the inside of the supply manifold, the direction in which liquid flows through the first circulation channel and the direction in which liquid flows through the second circulation channel is the forward direction (normal direction, same directions). Liquid flowing through the first circulation channel and entering the supply manifold has a relatively low temperature, and liquid flowing through the second circulation channel and entering the supply manifold from the vicinity of the nozzles has a relatively high temperature due to driving heat of the piezoelectric elements.

Thus, the circulation flow of liquid having the lower temperature is mixed with the circulation flow of liquid having the high temperature over a relatively long route (path) in the supply manifold. This homogenizes (uniformizes) the liquid temperature.

EMBODIMENTS

Figure 1:
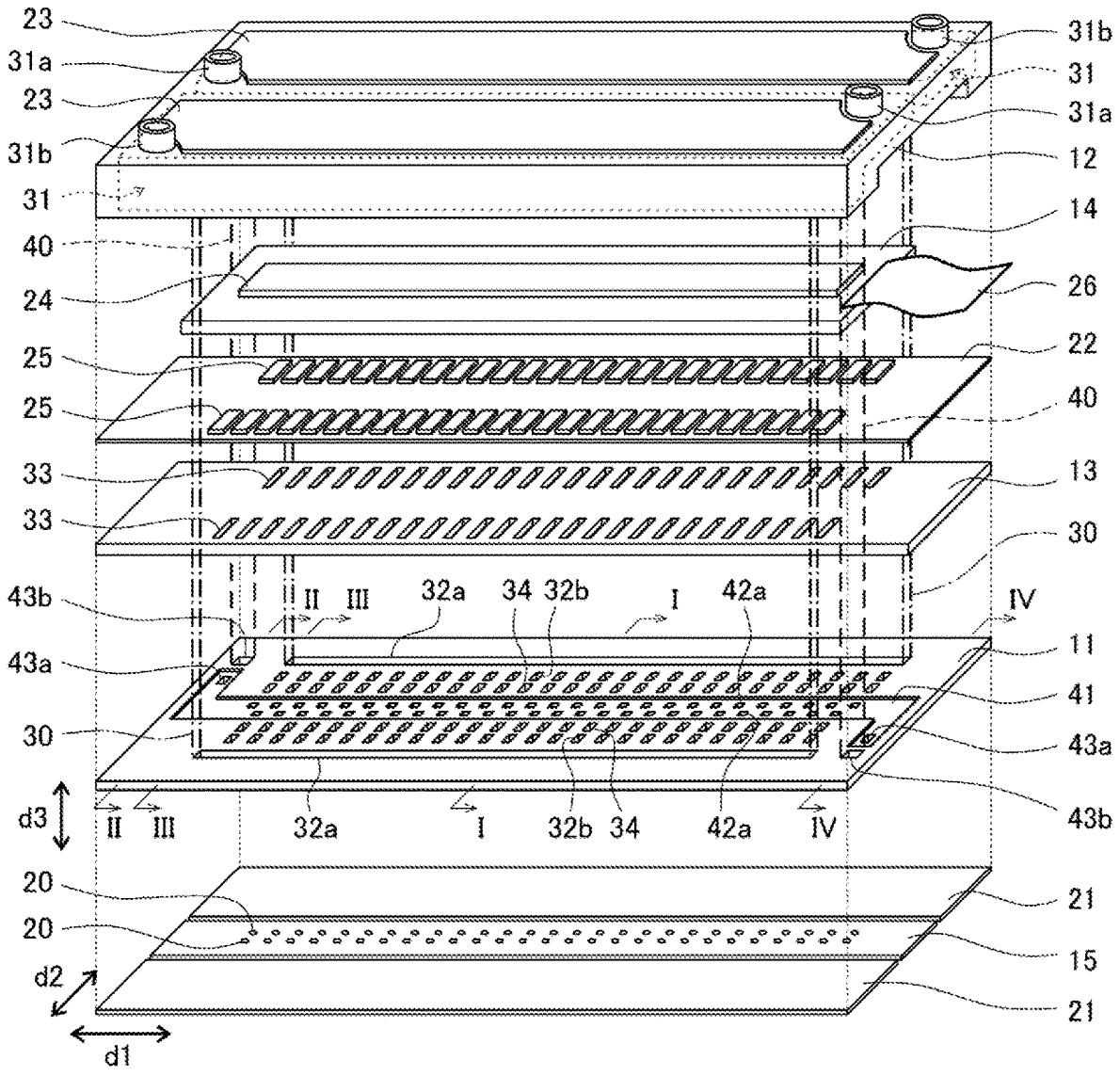
FIG. 1 is an exploded perspective view schematically depicting an exemplary configuration of a liquid jetting head according to an embodiment of the present disclosure.

Referring to the drawings, an embodiment of the present disclosure is explained below. In the following, the same or equivalent elements are designated by the same reference numerals throughout all of the drawings, any duplicate explanation thereof is omitted.

<Exemplary Basic Configuration of Liquid Jetting Head>

Figure 2:
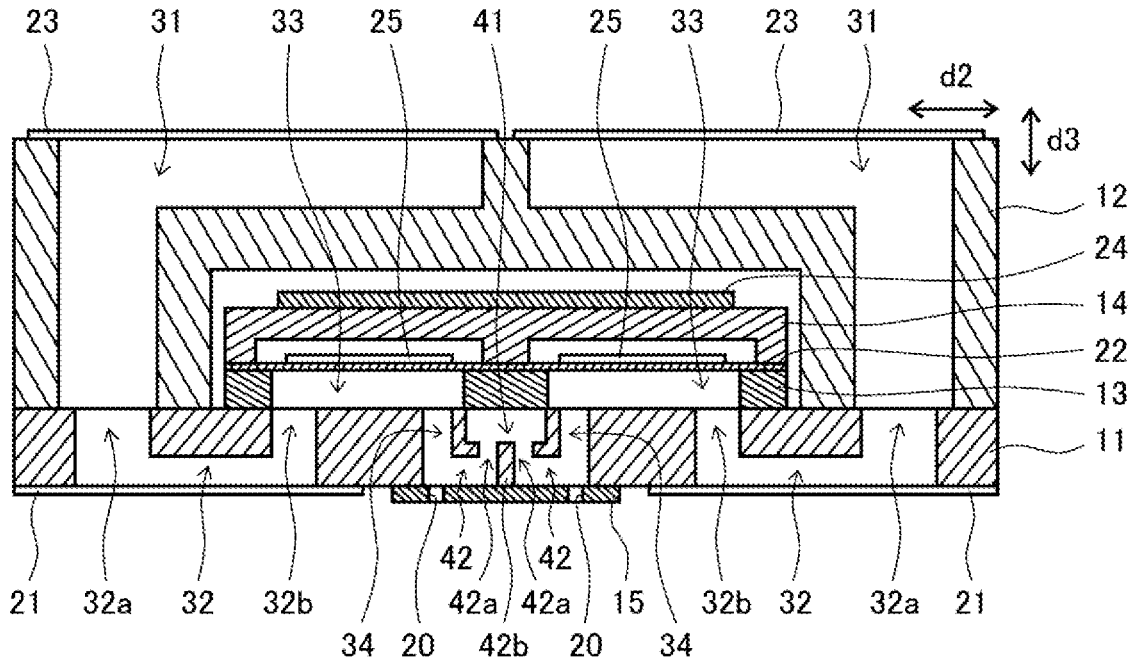
FIG. 2 is a schematic cross-sectional view of the liquid jetting head in FIG. 1 that is taken along a line I-I.

Referring to FIGS. 1 and 2, a specific explanation is made about an exemplary basic configuration of a liquid jetting head according to this embodiment. FIG. 1 is an exploded perspective view schematically depicting a representative configuration of the liquid jetting head according to this embodiment. FIG. 2 is a schematic cross-sectional view of the liquid jetting head that is taken along a line I-I in FIG. 1. FIG. 1 is depicted as the exploded perspective view for the purpose of easily explaining the configuration of the liquid jetting head. FIG. 2 is depicted as the cross-sectional view that is not an exploded view.

As depicted in FIGS. 1 and 2, the liquid jetting head according to this embodiment includes a channel member 11, a supply channel member 12, an actuator substrate 13, a protective substrate 14, a nozzle substrate 15, discharge-side damper members 21, an elastic film 22, supply-side damper members 23, a driving IC 24, piezoelectric elements 25, a lead-out wiring (trace) 26, and the like. Supply manifolds 31 are formed inside the supply channel member 12. In FIG. 1, the supply manifolds 31 are depicted by dotted lines.

The channel member (channel substrate) 11 has a flat-plate shape having a longitudinal direction. The channel member 11 is formed having spaces, openings, and the like used as liquid channels. In this embodiment, the channel member 11 is formed having a return manifold 41 described below, as depicted in FIG. 1. As depicted in FIG. 2, the channel member 11 is secured to a lower surface of the supply channel member 12. The actuator substrate 13, the protective substrate 14, and the like are secured to an upper surface of the channel member 11 at a position between the channel member 11 and the supply channel member 12. The nozzle substrate 15, the discharge-side damper members 21, and the like are secured to a lower surface of the channel member 11. The supply-side damper members 23 are secured to an upper surface of the supply channel member 12.

FIG. 2 depicts a cross-section of the liquid jetting head in FIG. 1 taken along the line I-I in a width direction orthogonal to a longitudinal direction. In this embodiment, the longitudinal direction of the liquid jetting head is defined as a "lengthwise direction", and directions orthogonal to the longitudinal direction are defined as "lateral directions". FIG. 2 is the cross-section of the liquid jetting head in one of the lateral directions. In FIGS. 1 and 2, the channel member 11 is positioned at a "lower" side and the supply channel member 12 is positioned at an "upper" side in the liquid jetting head. The positional relationship in the up-down direction is used below for explaining structure of the liquid jetting head.

When explaining a positional relationship of the liquid jetting head, the "longitudinal direction" (i.e., the lengthwise direction) is assumed as a reference direction, and the longitudinal direction can be defined as a "first direction". A left-right direction included in the "width directions" (i.e., the lateral directions) can be defined as a "second direction", and the up-down direction included in the "width directions" can be defined as a "third direction". In FIG. 1, the first direction is indicated by a two-way arrow d1. In FIGS. 1 and 2, the second direction is indicated by a two-way arrow d2. In FIGS. 1 and 2, the third direction is indicated by a two-way arrow d3. The definition of the two-way arrows indicating the directions are also applied to FIGS. 3 to 8.

In the following, when explanation is related to directions, the "longitudinal direction" is basically used. Regarding the direction orthogonal to the longitudinal direction, when it is not necessary to distinguish up, down, left, and right, "the width direction(s)" is used. When it is necessary to distinguish up, down, left, and right, "the up-down direction" or the "left-right direction" is used.

In this embodiment, part of the liquid jetting head provided with the nozzles 20 basically has a symmetric structure in the width direction (lateral direction, second direction, arrow d2), for example, as depicted in FIG. 2. Thus, when the structure of the liquid jetting head is explained referring to FIG. 2, only one of the left part and right part of the symmetric structure is explained and explanation of the other part is omitted.

Based on this positional relationship, in the liquid jetting head as depicted in FIGS. 1 and 2, the nozzle substrate 15 and the discharge-side damper members 21 are put on the lower surface of the channel member 11 with the channel member 11 as a reference. Further, not only the supply channel member 12 but also the actuator substrate 13 and the protective substrate 14 are put on the upper surface of the channel member 11. The supply-side damper members 23 are put on the upper surface of the supply channel member 12.

As depicted in FIGS. 1 and 2, the nozzle substrate 15 is positioned as a lower surface of the liquid jetting head, and the nozzles 20 are arranged in the lengthwise direction (longitudinal direction, first direction, arrow d1) in the nozzle substrate 15. In this embodiment, although rows of the nozzles 20 (nozzle rows) formed in the nozzle substrate 15 are two rows, the present disclosure, however, is not limited thereto. The interval (pitch) of the nozzles 20 forming the nozzle rows is not particularly limited, and may be an interval corresponding to density of dots formed when liquid is jetted (printing is performed) by the liquid jetting head.

As depicted in FIG. 1, the nozzle substrate 15, which is the lower surface of the liquid jetting head, is positioned at a center portion in the left-right direction (width direction, lateral direction, second direction). The discharge-side damper members 21 are positioned at both edges in the left-right direction (width direction) of the nozzle substrate 15. As depicted in FIG. 2, the channel member 11 is formed having an opening (or space) used as a liquid discharge channel 32 through which ink (liquid) is guided to the nozzle 20. The liquid discharge channel 32 is formed by putting the discharge-side damper member 21 on the lower surface of the channel member 11 to seal the opening used as the liquid discharge channel 32.

As depicted in FIG. 2, the liquid discharge channel 32 is formed as a channel extending in the width direction (lateral direction, second direction) in the channel member 11 by being sealed with the discharge-side damper member 21. A first end of the liquid discharge channel 32 is a liquid inflow port 32*a* formed in the upper surface of the channel member 11 at an outer side in the width direction. A second end of the liquid discharge channel 32 is a liquid outflow port 32*b* (or a supply throttle) formed in the upper surface of the channel member 11 at an inner side (center side) in the width direction. The liquid discharge channel 32 communicates with the supply manifold 31 via the liquid inflow port 32*a*, and communicates with the pressure chamber 33 via the liquid outflow port 32*b*.

The liquid discharge channels 32 are formed at the outer sides in the width direction (left-right direction) of the channel member 11, as depicted in FIG. 2. Descenders 34 and the return manifold 41 are formed at a center portion in the width direction of the channel member 11, as depicted in FIG. 2. As depicted in FIG. 1, the return manifold 41 is formed to extend in the longitudinal direction (lengthwise direction, first direction) in the upper surface of the channel member 11. The descenders 34 are arranged in the longitudinal direction at the outer sides in the width direction (left-right direction) of the return manifold 41. The descenders 34 are through holes (nozzle communicating channels) communicating with the nozzles 20. As described below, the descenders 34 communicate with the return manifold 41 via return introduction channels 42.

The actuator substrate 13 is stacked on a center portion in the left-right direction of the upper surface of the channel member 11. The elastic film 22 is stacked on an upper surface of the actuator substrate 13, and the protective substrate (support substrate) 14 is stacked on an upper surface of the elastic film 22. The protective substrate 14 protects the piezoelectric elements 25, and various traces (undepicted electrode traces described below, the lead-out wiring 26, and the like) are formed on the protective substrate 14. The protective substrate 14 is formed having a recess that is opened at a lower surface side. The recess is sealed with the elastic film 22 positioned on the lower surface side of the protective substrate 14. The piezoelectric elements 25 are arranged in the recess.

In other words, an "element space", which is a recess having a size not to inhibit driving of the piezoelectric elements 25, is formed in a portion corresponding to the piezoelectric elements 25. The "element space" functions as an area (space) for protecting the piezoelectric elements 25. Since the piezoelectric elements 25 are provided on the upper surface of the elastic film 22, the piezoelectric elements 25 are positioned at the lower side of the sealed recess (element space).

The pressure chambers 33 that are through holes are formed in the actuator substrate 13 immediately below the respective piezoelectric elements 25. An upper surface of the pressure chamber 33 is sealed by the elastic film 22, and a lower surface of the pressure chamber 33 is sealed by the upper surface of the channel member 11. The liquid discharge channels 32 of the channel member 11 communicate with the pressure chambers 33 via the liquid outflow ports 32*b* as described above. The descenders (nozzle communicating channels) 34 of the channel member 11 also communicate with the respective pressure chambers 33. As depicted in FIG. 2, a first portion in the width direction of the lower surface of the pressure chamber 33 communicates with the liquid discharge channel 32, and a second portion of the pressure chamber 33 communicates with the descender 34.

The pressure chambers 33 formed in the actuator substrate 13 correspond to the nozzles 20 formed in the nozzle substrate 15. In this embodiment, the nozzles 20 formed in the nozzle substrate 15 are arranged in the longitudinal direction (lengthwise direction, first direction) as depicted in FIG. 1. In this embodiment, the nozzles 20 are formed into two nozzle rows. Thus, the pressure chambers 33 formed in the actuator substrate 13 are formed in two rows in the longitudinal direction while corresponding to the nozzle rows, as depicted in FIG. 1. Since the piezoelectric elements 25 are provided on the elastic film 22 while corresponding to the pressure chambers 33, the piezoelectric elements 25 are formed in two rows in the longitudinal direction while corresponding to the nozzle rows and the pressure chambers 33, as depicted in FIG. 1.

As described above, the descenders 34 communicate with the nozzles 20 to supply liquid to the nozzles 20. Thus, the descenders 34 are formed in two rows in the longitudinal direction in the channel member 11, as depicted in FIG. 1. Similarly, the liquid discharge channels 32 communicate with the descenders 34 via the pressure chambers 33. Thus, as depicted in FIG. 1, the liquid outflow ports 32*b* of the liquid discharge channels 32 are arranged at outer sides of the descenders 34 in the width direction so that the row of the liquid outflow ports 32*b* are parallel to the row of the descenders 34. The liquid outflow ports 32*b* are formed in two rows along the longitudinal direction. The liquid inflow ports 32*a* are arranged at outer sides of the liquid outflow ports 32*b* in the width direction so that the row of the liquid inflow ports 32*a* are parallel to the row of the liquid outflow ports 32*b*. The liquid inflow ports 32*a* are formed in two rows along the longitudinal direction.

That is, in the example depicted in FIG. 1, the rows of the liquid inflow ports 32*a* are formed along the longitudinal direction (lengthwise direction, first direction) at the outer sides in the width direction (lateral direction, second direction) in the upper surface of the channel member 11. The rows of the liquid outflow ports 32*b* are formed along the longitudinal direction at the inner sides in the width direction of the rows of the liquid inflow ports 32*a*. The rows of the descenders 34 are formed along the longitudinal direction at the inner sides in the width direction of the rows of the liquid outflow ports 32*b*. The return manifold 41 extending along the longitudinal direction is formed between the two rows of the descenders 34. The return manifold 41 communicates with the supply manifolds 31 as described below.

As depicted in FIG. 1, the lead-out wiring 26 is connected to an end in the longitudinal direction (lengthwise direction, first direction) of the protective substrate 14. The lead-out wiring 26 is connected to the driving IC 24. The electrode traces (not depicted) extend from the driving IC 24 to the piezoelectric elements 25. The driving IC 24 thus drives the piezoelectric elements 25 forming the rows along the longitudinal direction.

As described below, when the piezoelectric element 25 is driven by the driving IC 24, the elastic film 22 curves (is deformed to be convex) toward the pressure chamber 33. This ejects (discharges) ink (liquid) in the pressure chamber 33 from the nozzle 20 to the outside via the descender 34. An actuator unit is thus formed by the channel member 11, the actuator substrate 13, the elastic film 22, the piezoelectric element 25, and the like.

As depicted in FIGS. 1 and 2, the supply channel member 12 is disposed to cover the channel member 11 as well as the actuator substrate 13 and the protective substrate 14 that are positioned on the upper surface of the channel member 11. As described above, the supply channel member 12 is formed having the supply manifolds (supply channels) 31 through which ink (liquid) is supplied to the liquid discharge channels 32 of the channel member 11. The upper surface of the supply channel member 12 is sealed with the supply-side damper members 23.

In this embodiment, the supply manifold 31 is formed by a first area and a second area as depicted in FIG. 2. The first area extends in the longitudinal direction (lengthwise direction, first direction) and the width direction (lateral direction, second direction) in an upper portion of the supply channel member 12. The second area extends in the longitudinal direction and the up-down direction (third direction, arrow d3) at the outer side in the width direction (second direction) of the supply channel member 12. Thus, as depicted in FIG. 2, the supply manifold 31 has a L-shaped transverse section formed by the first area positioned at the upper side and extending in the width direction and the second area extending downward from the lower outer side of the first area. A lower portion of the second area of the supply manifold 31 communicates with the liquid discharge channel 32 via the liquid inflow port 32*a*.

As described above, the liquid discharge channel 32 communicates with the descender 34 via the pressure chamber 33, and the descender 34 communicates with the nozzle 20. Thus, ink (liquid) supplied from the supply manifold 31 is guided to the nozzle 20 via the liquid discharge channel 32, the pressure chamber 33, and the descender 34.

The supply manifolds 31 are connected to an ink cartridge (or an ink tank, not depicted) and ink (liquid) is supplied from the ink cartridge. Ink supplied from the ink cartridge is not only supplied to the channel member 11 via the supply manifold 31 but also returns to the ink cartridge from the supply manifold 31. Each supply manifold 31 is thus formed having a part of a first circulation channel through which liquid (ink) in the supply manifold 31 circulates. A specific configuration of the first circulation channel is described below. The supply manifolds 31 may directly communicate with (may be directly connected to) the ink cartridge (ink tank, ink supply section, or the like) via a publicly-known supply path or the like. The supply manifolds 31 may indirectly communicate with the ink cartridge (ink tank, ink supply section, or the like) via a publicly-known member or the like.

The channel member 11 is formed having the return manifold 41 as described above. The return manifold 41 communicates with the descenders 34. Thus, liquid (ink) supplied from the descenders 34 and not discharged from the nozzles 20 is guided to the return manifold 41. Since the return manifold 41 communicates with the supply manifolds 31, liquid (ink) not discharged from the nozzles 20 is circulated to (returns to) the supply manifolds 31. The return manifold 41 thus forms a second circulation channel that is different from the first circulation channel and through which liquid (ink) circulates. A specific configuration of the second circulation channel is described below.

In the liquid jetting head according to the present disclosure, the specific configurations of the channel member 11, the supply channel member 12, the actuator substrate 13, the protective substrate 14, the nozzle substrate 15, the discharge-side damper members 21, the elastic film 22, the supply-side damper members 23, the driving IC 24, the piezoelectric elements 25, the lead-out wiring 26, and the like are not particularly limited, and publicly-known configurations in the liquid jetting head can be suitably used. The specific configuration of the liquid jetting head according to the present disclosure is not limited to the configuration in this embodiment depicted in FIG. 1 and FIG. 2. Some of the constitutive parts or components may be omitted provided that the present disclosure can be carried out, or any other publicly-known component in a field of the liquid jetting head may be provided.

A method of producing the liquid jetting head is not particularly limited. The liquid jetting head may be produced by securing or installing of the respective components (members and the like) including the channel member 11, the supply channel member 12, the actuator substrate 13, the protective substrate 14, the nozzle substrate 15, the discharge-side damper members 21, the elastic film 22, the supply-side damper members 23, the driving IC 24, the piezoelectric elements 25, the lead-out wiring 26, and the like, through a publicly-known method. The order of securing or installation of the respective components and the like is not particularly limited. The method of producing the liquid jetting head is exemplified as follows. For example, a channel unit may be formed by the channel member 11, the discharge-side damper members 21, the nozzle substrate 15, and the like, and the actuator unit may be formed by the actuator substrate 13, the elastic film 22, the piezoelectric elements 25, the protective substrate 14, and the like. Then, the channel unit may be secured to the actuator unit.

Although the securing method or installation method of the respective components, the method for securing the units, the securing method or installation method of the units and the components (members), and the like are not particularly limited, it is possible to typically adopt a method using publicly-known adhesive. A joining method not using adhesive may be adopted depending on a type, a material, or the like of the components (members).

Figure 3:
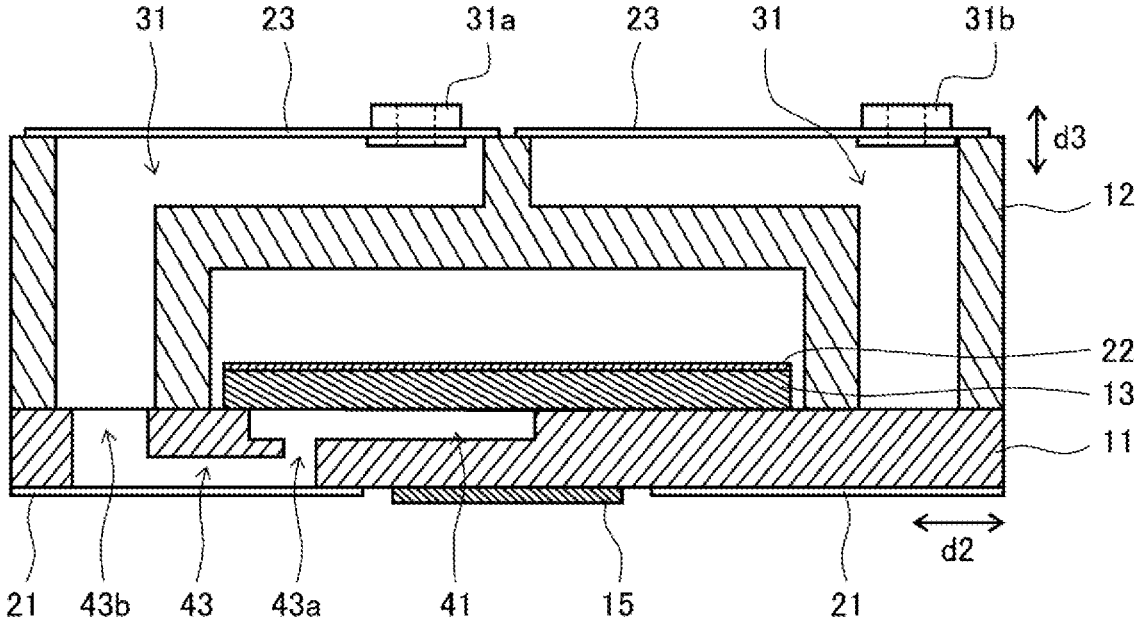
FIG. 3 is a schematic cross-sectional view of the liquid jetting head in FIG. 1 that is taken along a line II-II in FIG. 1.
Figure 5:
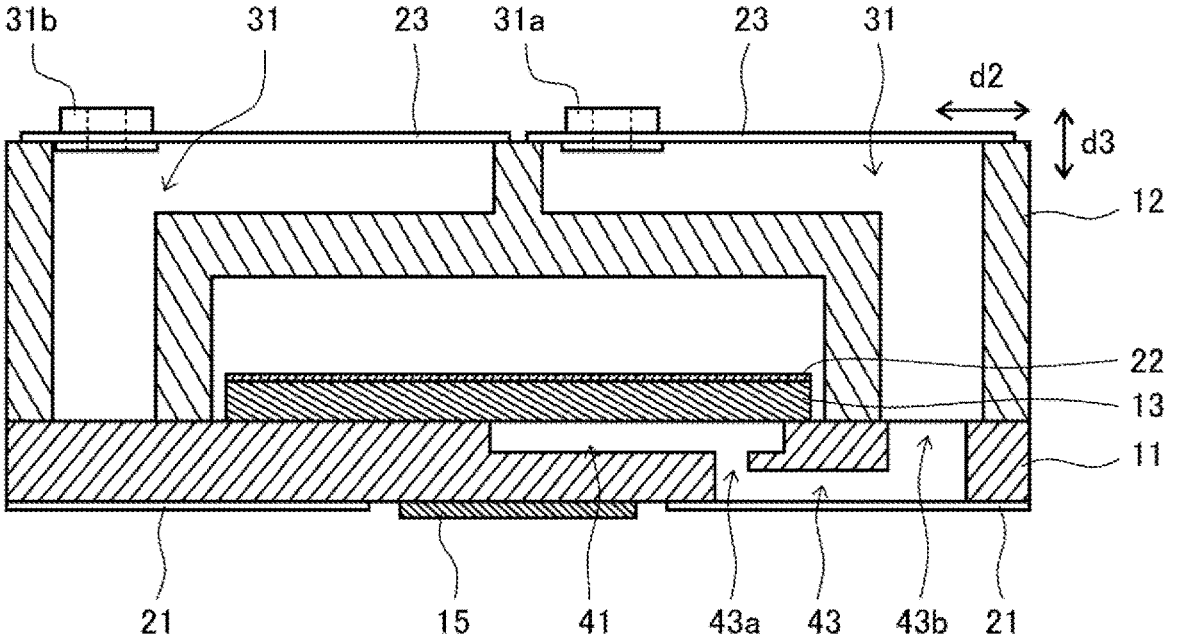
FIG. 5 is a schematic cross-sectional view of the liquid jetting head in FIG. 1 that is taken along a line Iv-Iv in FIG. 1.

In this embodiment, the inflow port 31*a* and the outflow port 31*b* are provided in the supply-side damper members 23 as independent (separated) members as depicted in FIG. 3 or FIG. 5. The configuration of the inflow port 31*a* and the outflow port 31*b* is not limited thereto. For example, at least one of the inflow port 31*a* and the outflow port 31*b* may be formed integrally with the supply channel member 12 provided that no supply-side damper member 23 is provided and the supply channel member 12 as a casing has the supply manifold 31 as an inner space.

<Return Manifold and Return Channel>

Figure 4:
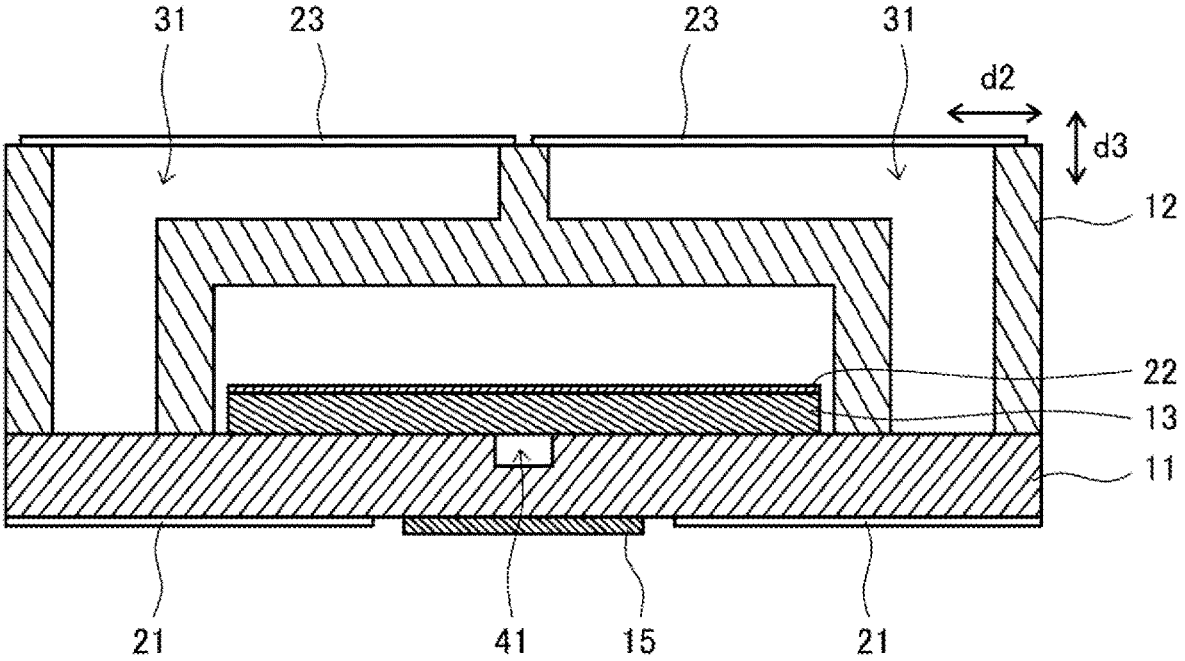
FIG. 4 is a schematic cross-sectional view of the liquid jetting head in FIG. 1 that is taken along a line in FIG. 1.

Subsequently, referring to FIGS. 1 to 5, explanation is made about specific configurations of the return manifold 41 and return channels 43 communicating with the return manifold 41. FIG. 3 is a schematic cross-sectional view of the liquid jetting head that is taken along a line II-II in FIG. 1. FIG. 4 is a schematic cross-sectional view of the liquid jetting head that is taken along a line in FIG. 1. FIG. 5 is a schematic cross-sectional view of the liquid jetting head that is taken along a line IV-IV in FIG. 1. Although FIG. 1 is the exploded perspective view for the purpose of explaining the configuration of the liquid jetting head easily, FIGS. 3 to 5 are cross-sectional views that are not exploded views similar to FIG. 2.

FIG. 2, which is a transverse section view of the liquid jetting head taken along the line I-I in FIG. 1, depicts part of the liquid jetting head provided with the nozzles 20 as described above. FIG. 3, which is a transverse section view of the liquid jetting head taken along the line II-II in FIG. 1, depicts the vicinity of an end in the longitudinal direction of the liquid jetting head. FIG. 5, which is a transverse section view of the liquid jetting head taken along the line IV-IV in FIG. 1, depicts the vicinity of the other end in the longitudinal direction of the liquid jetting head. Each of FIG. 3 and FIG. 5 depicts a specific configuration in which one of the ends of the return manifold 41 communicates with the supply manifold 31. FIG. 4 is a cross-sectional view of the liquid jetting head at a position between the transverse section depicted in FIG. 3 and the transverse section depicted in FIG. 2.

As depicted in FIG. 1, the return manifold 41 has a groove-like shape extending along the longitudinal direction (lengthwise direction, first direction) in the upper surface of the channel member 11. As depicted in FIG. 2, the return manifold 41 communicates with the descenders 34. Each of the descenders 34 is formed having a return introduction channel 42 (or a return throttle) that extends in the width direction (lateral direction, second direction) at the side of the nozzle substrate 15 (lower side) to communicate with the return manifold 41. A first end of the return introduction channel 42 communicates with the descender 34 and a second end of the return introduction channel 42 is formed as a return introduction opening 42*a* that communicates with a bottom surface of the return manifold 41. Thus, as depicted in FIG. 1, the return introduction openings 42*a* are formed in two rows along the rows of the descenders 34 (along the longitudinal direction) in the bottom surface (lower surface) of the return manifold 41.

In this embodiment, two nozzle rows are formed by arranging the nozzles 20 such that the nozzle rows are parallel to each other on the nozzle substrate 15, as depicted in FIG. 1. The return manifold 41 communicates with the descenders 34 that communicate with the nozzles 20 forming the two nozzle rows. Thus, one return manifold 41 communicates with the two nozzle rows. In this configuration, there is no need to provide one return manifold 41 for one nozzle row, thus avoiding a complicated configuration.

The nozzle rows are not limited to the two nozzle rows, and three or more nozzle rows may be provided. In that case, one return manifold 41 may be provided for the three or more nozzle rows. Or, a plurality of return manifolds 41 may be provided so that each of one or more of the return manifold(s) 41 corresponds to the plurality of nozzle rows and each of remaining one or more of the return manifold(s) 41 corresponds to one of the nozzle rows. One return manifold 41 may be provided to correspond to one nozzle row in the configuration example depicted in FIG. 1.

As depicted in FIG. 2, a wall 42*b* is provided between the return introduction channels 42 facing each other. The descenders 34 communicate not only with the nozzles 20 but also with the return introduction channels 42 as described above. It is possible to inhibit the crosstalk between the nozzles 20 facing each other by providing the wall 42*b* between the return introduction channels 42 facing each other.

In the configuration example according to this embodiment, the return manifold 41 extends along the longitudinal direction (lengthwise direction, first direction) in a center portion in the width direction (lateral direction, second direction) of the channel member 11. The configuration of the return manifold 41, however, is not limited thereto. The return manifold 41 may be provided in any other position than the center portion, or may extend in a direction that is not along the longitudinal direction. Since the return manifold 41 is positioned in the center portion in the width direction to extend in the lengthwise direction, the return manifold 41 can be provided in a relatively stable position in view of the structure of the liquid jetting head. Especially, in the configuration formed having the two nozzle rows, one return manifold 41 can be disposed between the two nozzle rows. The second circulation channels described below can be thus formed simply.

In this embodiment, large part of the return manifold 41 is positioned at the center portion in the width direction and extends in the longitudinal direction, and both ends of the return manifold 41 extending in the longitudinal direction are bent at a right angle in the width direction. The bent ends of the return manifold 41 communicate with the return channels 43, as depicted in FIGS. 3 and 5. The return channels 43 are openings (or spaces) formed at both ends in the longitudinal direction of the channel member 11. The return channels 43 are formed as channels extending in the width direction by being sealed with the discharge-side damper members 21, similar to the liquid discharge channels 32.

A first end of the return channel 43 is a return communication opening 43*a* that is formed in the upper surface of the channel member 11 at the inner side (center side) in the width direction. A second end of the return channel 43 is a return port 43*b* that is formed in the upper surface of the channel member 11 at the outer side in the width direction. Similar to the return introduction opening 42*a*, the return communication opening 43*a* is formed in the bottom surface (lower surface) of the groove-like return manifold 41. As depicted in FIGS. 3 and 5, the return ports 43*b* communicate with lowers end of the supply manifolds 31. Thus, the return ports 43*b* correspond to an "outflow port" of the return channel 43 formed in the channel member 11 as well as an "inflow port" (or a return opening) formed in the supply manifold 31.

As depicted in FIGS. 1, 3, and 5, the supply manifold 31 is provided with the inflow port 31*a* from which ink (liquid) inflows from the ink cartridge (or ink tank, not depicted) to the supply manifold 31 and the outflow port 31*b* from which ink (liquid) flows out of the supply manifold 31. A positive-pressure pump is provided between the ink cartridge and the inflow port 31*a*. Ink is pressurized from the positive-pressure pump toward the supply manifold 31 and supplied to the supply manifold 31. A negative-pressure pump is provided between the ink cartridge and the outflow port 31*b*. Ink is drawn from the supply manifold 31 by the negative-pressure pump and is supplied to the ink cartridge. Since the ink cartridge is provided at the upper side of the supply channel member 12, the inflow port 31*a* and the outflow port 31*b* are provided in the upper surface of the supply manifold 31 (in this embodiment, in the supply-side damper member 23 sealing the supply manifold 31). Since the return port 43*b* is the "outflow port" of the return channel 43 positioned in the lower surface of the supply channel member 12, the return port 43*b* is provided in the lower surface of the supply manifold 31.

A specific configuration of the return channel 43 is not especially limited. The return channel 43 may have any configuration provided that the return channel 43 communicates with an end of the return manifold 41 and communicates with the supply manifold 31 via the return port 43*b*. In this embodiment, large part of the return channel 43 extends in the width direction (lateral direction, second direction). The return port 43*b*, which is an end of the return channel 43, is positioned in the upper surface of the channel member 11. The return channel 43 thus includes an "upward channel" (through hole in the up-down direction in the vicinity of the return port 43*b*) that extends upward from the end of the return manifold 41 and is connected to the supply manifold 31.

It is possible to provide each return channel 43 to avoid various components positioned at the upper side of the return manifold 41, such as the actuator substrate 13, the elastic film 22, the protective substrate 14, and the driving IC 24, as depicted in FIG. 3 or FIG. 5, by allowing part of the return channel 43 as the upward channel to communicate with the supply manifold 31. This improves the flexibility of a layout of the second circulation channel described below.

Especially, in the configuration example depicted in FIG. 1 and the configuration example depicted in FIG. 3 or FIG. 5, the protective substrate 14 is positioned on the lower side of the supply manifolds 31 and the upper side of the return manifold 41. The protective substrate 14 is positioned at the center portion in the width direction (lateral direction, second direction) and extends along the longitudinal direction (lengthwise direction, first direction). As depicted in FIG. 3 or FIG. 5, the upward channel of the return channel 43 is formed at the outer side in the width direction when seen from the protective substrate 14. In this configuration, since the return channels 43 are disposed in the liquid jetting head at positions where no protective substrate 14 is provided, the second circulation channels can be provided without changing the layout of the protective substrate 14.

Since FIGS. 3 and 5 depict the vicinities of the ends in the longitudinal direction of the liquid jetting head, the recess (element space) is not formed in the protective substrate 14 and the pressure chamber 33 is not formed in the actuator substrate 13. Although the return manifold 41 and the return channel 43 are formed in the channel member 11 at one side in the width direction (left side in FIG. 3 and right side in FIG. 5), the descender 34 is not formed and the nozzle 20 is not formed in the nozzle substrate 15. That is, main parts of the actuator unit are not provided in the vicinity of the end in the longitudinal direction of the liquid jetting head depicted in FIG. 3 or FIG. 5.

FIG. 4 is a transverse section view depicting a portion between the vicinity of the end in the longitudinal direction of the liquid jetting head depicted in FIG. 3 and the part of the liquid jetting head provided with the nozzle rows depicted in FIG. 2. Thus, only the return manifold 41 is positioned at the center portion in the width direction of the upper surface of the channel member 11, and the return channel 43 and the like is not provided. Main parts of the actuator unit (piezoelectric element 25, pressure chamber 33, descender 34, nozzle 20) and the like are also not provided. A transverse section similar to FIG. 4 also exists between the vicinity of the end depicted in FIG. 5 and the part provided with the nozzle rows depicted in FIG. 2.

<First Circulation Channel and Second Circulation Channel>

Referring to FIGS. 1 to 7 (especially FIGS. 6 and 7), explanation is made about specific examples of the first circulation channel partly formed (partly defined) in each supply manifold 31 and the second circulation channel including the return manifold 41 and the return channel 43.

Figure 6:
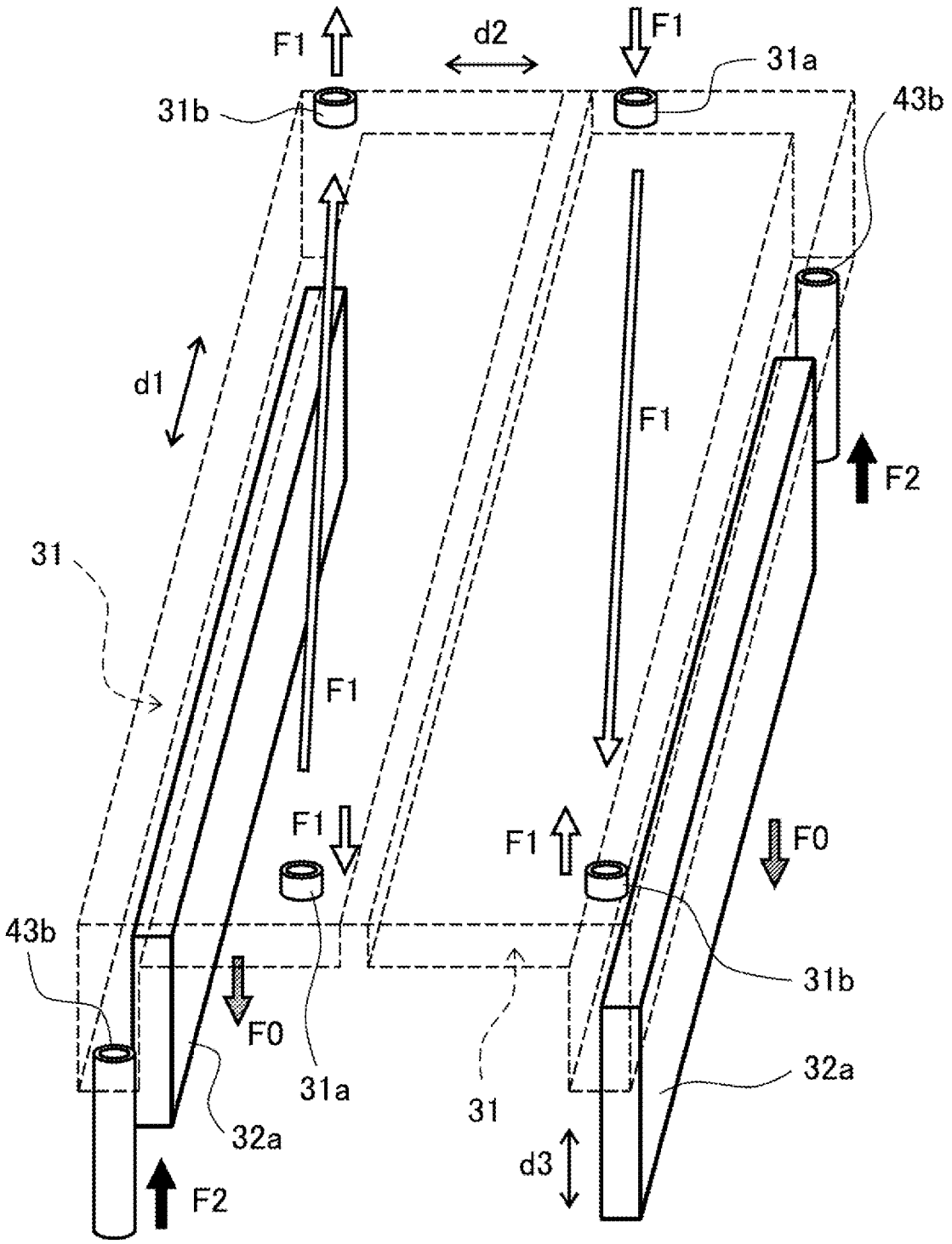
FIG. 6 is a schematic perspective view of an exemplary state where liquid circulates through supply manifolds of the liquid jetting head in FIG. 1.
Figure 7:
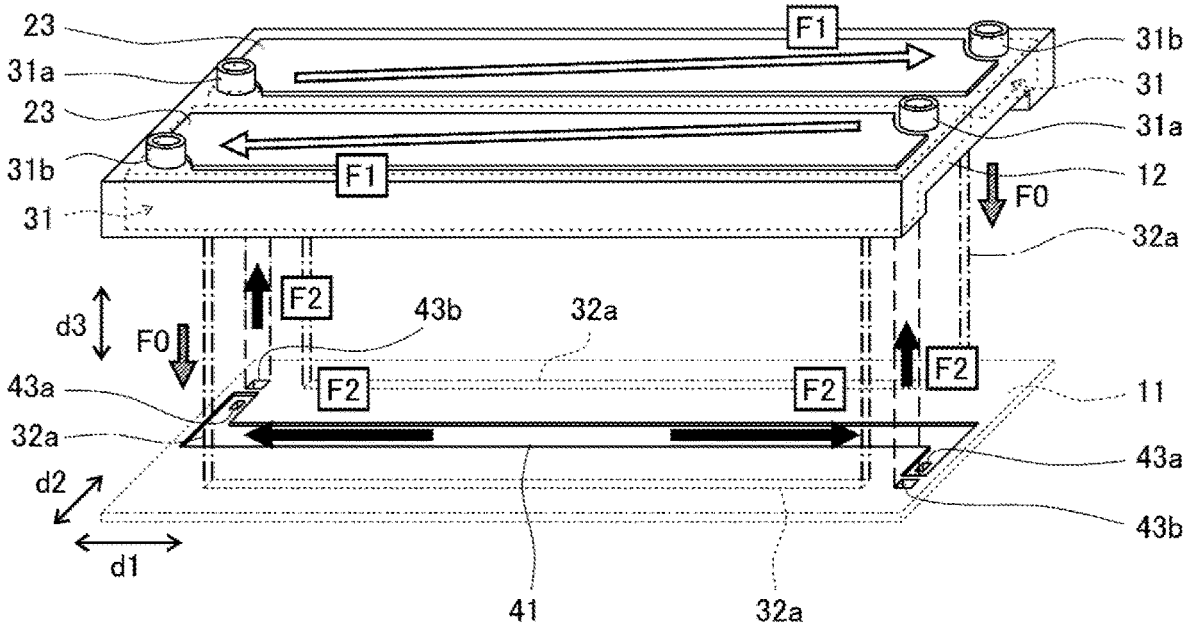
FIG. 7 is an exploded perspective view schematically depicting an exemplary state where liquid circulates through a return manifold of the liquid jetting head in FIG. 1.

For the purpose of explaining the first circulation channels, FIG. 6 depicts the supply manifolds 31 by dotted lines and a situation in which liquid (ink) inflows into or flows out of the supply manifolds 31 by block arrows or solid (three-dimensional) figures. For the purpose of explaining the second circulation channels, FIG. 7 depicts the channel member 11 except for the return manifold 41 by dotted lines, and omits various components (actuator substrate 13, elastic film 22, protective substrate 14, and the like) interposed between the supply channel member 12 and the channel member 11. Similar to FIG. 1, the supply manifolds 31 in the supply channel member 12 are depicted by dotted lines in FIG. 7.

Each of the first circulation channels is a liquid circulation channel partly formed (partly defined) in the corresponding one of the supply manifolds 31 of the liquid jetting head. Since the inflow port 31*a* and the outflow port 31*b* communicating with the ink cartridge communicates also with the supply manifold 31, the first circulation channel is formed as a channel through which liquid (ink) in the supply manifold 31 circulates along the longitudinal direction (lengthwise direction, first direction), as indicated by an outline arrow F1 in FIG. 6.

A first end in the longitudinal direction of each first circulation channel (a first end of part of the first circulation channel formed by the supply manifold 31) is the outflow port 31*b* through which liquid flows out of the supply manifold 31. A second end in the longitudinal direction of each first circulation channel (a second end of the part of the first circulation channel formed by the supply manifold 31) is the inflow port 31*a* through which liquid flows from the ink cartridge (not depicted) into the supply manifold 31. In this embodiment, as depicted in FIGS. 1 to 5, the supply manifolds 31 are provided in the supply channel member 12 so that they are symmetric to each other in the width direction (lateral direction, second direction). Thus, the two supply manifolds 31 are respectively provided with the inflow ports 31*a* and the outflow ports 31*b*. In the supply manifold 31 disposed at the far side in the supply channel member 12 depicted in FIG. 1, the outflow port 31*b* is positioned at the far-right side and the inflow port 31*a* is positioned at the near-left side. In the supply manifold 31 disposed at the near side in the supply channel member 12 depicted in FIG. 1, the inflow port 31*a* is positioned at the far-right side and the outflow port 31*b* is positioned at the near-left side.

As depicted in FIG. 3, the outflow port 31*b* is provided at a right portion of the upper surface of the supply manifold 31 positioned at the right side in FIG. 3, and the inflow port 31*a* is provided at a right portion of the upper surface of the supply manifold 31 positioned at the left side in FIG. 3. As depicted in FIG. 5, the inflow port 31*a* is provided at a left portion of the upper surface of the supply manifold 31 positioned at the right side in FIG. 5, and the outflow port 31*b* is provided at a left portion of the upper surface of the supply manifold 31 positioned at the left side in FIG. 5.

FIG. 6 depicts a state where the liquid jetting head having the configuration depicted in FIG. 1 is seen from the left side in FIG. 1 obliquely in the longitudinal direction (lengthwise direction, first direction) (along the same direction as the arrow direction indicated by the lines I-I, II-II, and IV-IV in FIG. 1). In the supply manifold 31 positioned at the right side in FIG. 6, the outflow port 31*b* is positioned at the right side of a lower end in the longitudinal direction, and the inflow port 31*a* is positioned at the left side of an upper end in the longitudinal direction. In the supply manifold 31 positioned at the left side in FIG. 6, the outflow port 31*b* is positioned at the left side of an upper end in the longitudinal direction, and the inflow port 31*a* is positioned at the right side of a lower end in the longitudinal direction.

Thus, in this embodiment, the inflow port 31*a* and the outflow port 31*b* forming each first circulation channel are positioned at corners of the upper surface of the supply manifold 31 to face each other on a diagonal line. Thus, as depicted by each outline arrow F1 in FIG. 6, in the first circulation channel, liquid (ink) flowing from the ink cartridge (not depicted) into each supply manifold 31 via the inflow port 31*a* flows along the diagonal line in an upper portion (first area) of the supply manifold 31, and flows out into the ink cartridge via the outflow port 31*b*.

The supply manifold 31 functions also as a supply channel for supplying liquid (ink) to the nozzles 20. Thus, as indicated by the solid (three-dimensional) figure having a block-like plate shape and a hatched block arrow F0 in FIG. 6, liquid (ink) is supplied from large part of a lower portion (second area) of each supply manifold 31 to the liquid discharge channel 32 via the liquid inflow port 32*a*, and supplied to each nozzle 20 via the pressure chamber 33 and the descender 34 (see FIG. 2). In FIGS. 1 and 7, the flowing of liquid from each liquid discharge channel 32*a* is schematically indicated by dot-dash chain lines, and the flowing direction of the liquid from each liquid discharge channel 32*a* is indicated by the hatched block arrow F0 in FIG. 7 similar to FIG. 6.

The second circulation channel is a circulation channel through which liquid not discharged from the nozzles 20 returns to the supply manifold 31. The second circulation channel includes the return manifold 41 and the return channel 43 as described above. The return manifold 41 communicates with the descenders 34 as described above. Each descender 34 communicates with the corresponding nozzle 20, and each return channel 43 communicates with the supply manifold 31 via the return port 43*b*. Thus, ink (liquid) not discharged from the nozzles 20 is guided to the supply manifold 31 via the return manifold 41 and the return channel 43.

Specifically, as indicated by black block arrows F2 in FIG. 7, liquid (ink) introduced into the return manifold 41 from the descenders 34 flows to both ends of the return manifold 41. Since the return channels 43 and the return ports 43*b* that are "outflow ports" of the return channels 43 communicate with the ends of the return manifold 41, liquid from the return manifold 41 flows into the return channels 43.

As the flowing of liquid from each return port 43*b*, the liquid flowing into the return channel 43 flows into (returns to) the supply manifold 31 from the lower side of the end in the longitudinal direction of the supply manifold 31, as schematically indicated by the dotted line in FIG. 7. The channel resistance of the liquid inflow port 32*a* is lower than the channel resistance of the outflow port 31*b* and the return port 43*b*, and thus large part of the liquid flowing from the inflow port 31*a* flows to the liquid inflow port 32*a*. Liquid flowing to the liquid inflow port 32*a* is supplied to the liquid discharge channels 32, passing the nozzles 20, and returns to the supply manifold 31 from the return manifold 41 and the return port 43*b*. Flowing of ink from the liquid inflow port 32*a* to the return port 43*b* may be generated by providing a positive-pressure pump in a channel from the liquid inflow port 32*a* to the nozzles 20, or providing a negative-pressure pump in a channel from the nozzles 20 to the return port 43*b*. In order to improve (smooth) the flowing of ink, absolute pressure of the positive-pressure pump provided in the channel from the liquid inflow port 32*a* to the nozzles 20 is desirably smaller than absolute pressure of the positive-pressure pump provided between the ink cartridge and the inflow port 31*a*. Similar to the above, absolute pressure of the negative-pressure pump provided in the channel from the nozzles 20 to the return port 43*b* is desirably smaller than absolute pressure of the negative-pressure pump provided between the ink cartridge and the outflow port 31*a*. In FIG. 6, the flowing of liquid from each return port 43*b* is schematically depicted as a cylindrical figure together with the black block arrow F2. In FIG. 1, the flowing of liquid from each return port 43*b* is schematically depicted by the dotted line similar to FIG. 7.

In the first circulation channel and the second circulation channel, the return port 43*b* is provided in the supply manifold 31 at a position closer to the inflow port 31*a* than to the outflow port 31*b*. For example, as depicted on the left side in FIG. 6 (also see FIGS. 3 and 5), the return port 43*b* positioned at an end on the lower side in the longitudinal direction of the supply manifold 31 is not close to the outflow port 31*b* positioned at an end on the upper side in the longitudinal direction of the supply manifold 31, but close to the inflow port 31*a* positioned at a center-side in the width direction of the end on the lower side in the longitudinal direction. As depicted on the right side in FIG. 6, the return port 43*b* positioned at the end on the upper side in the longitudinal direction of the supply manifold 31 is not close to the outflow port 31*b* positioned at the end on the lower side in the longitudinal direction of the supply manifold 31, but close to the inflow port 31*a* positioned at a center-side in the width direction of the end on the upper side in the longitudinal direction.

As described above, the liquid jetting head according to the present disclosure includes the first circulation channel through which liquid in each supply manifold 31 circulates and the second circulation channel through which liquid in the vicinity of the nozzles 20 is circulated to (returns to) the each supply manifold 31. The position (return port 43*b*) where liquid enters the supply manifold 31 from the second circulation channel is closer to the position (inflow port 31*a*) where liquid enters the supply manifold 31 than to the position (outflow port 31*b*) where liquid flowing through (along) the first circulation channel flows out of the supply manifold 31. In this configuration, liquid circulates so that a circulation direction of liquid in each supply manifold 31 (flowing direction of liquid in each first circulation channel) is opposite to a circulation direction of liquid from the vicinity of the nozzles 20 (flowing direction of liquid in each second circulation channel).

When seeing the entire liquid jetting head, the circulation direction (block arrow F1) of each first circulation channel is opposite to the circulation direction (block arrow F2) of each second circulation channel. When seeing the inside of the supply manifold 31, the direction in which liquid flows into the supply manifold 31 along each first circulation channel and the direction in which liquid flows into the supply manifold 31 along each second circulation channel are a forward direction (normal direction, that is the same directions). Liquid flowing through the first circulation channel and entering (returning to) the supply manifold 31 has a relatively low temperature, and liquid flowing through the second circulation channel and entering (returning to) the supply manifold 31 from the vicinity of the nozzles 20 has a relatively a high temperature due to driving heat of the piezoelectric elements 25. Thus, the circulation flow of liquid having the lower temperature is mixed with the circulation flow of liquid having the high temperature over a relatively long route in the supply manifold 31. This homogenizes or uniformizes the liquid temperature.

In this embodiment, as depicted in FIG. 6, the outflow direction of liquid (see each block arrow F1) in which liquid flowing through (along) the first circulation channel flows out of the supply manifold 31 via the outflow port 31*b* is preferably the same as the inflow direction of liquid in which liquid enters the supply manifold 31 along each second circulation channel via the return port 43*b*. When the inflow direction of liquid in which liquid flows in from the return port 43*b* of the second circulation channel is the same as the outflow direction of liquid in which liquid flows out of the outflow port 31*b* of the first circulation channel apart from the return port 43*b*, the direction in which liquid flows from (along) the first circulation channel and the direction in which liquid flows from (along) the second circulation channel can be easily regulated in the forward direction (normal direction) in the supply manifold 31.

In this embodiment, as depicted in FIGS. 1, 6, and 7, the outflow port 31*b* and the inflow port 31*a* of each first circulation channel are positioned at the ends in the longitudinal direction (lengthwise direction, first direction) in each supply manifold 31. The return port 43*b* of each second circulation channel is positioned to face the inflow port 31*a*. As described above, it is possible to lengthen a route along which liquid circulates through the supply manifold 31 by providing the first circulation channel to communicate with the both ends of the supply manifold 31 and providing the return port 43*b* of the second circulation channel to face the inflow port 31*a* of the first circulation channel. The liquid temperature can be homogenized or uniformized more sufficiently by such configuration.

As described above, a liquid jetting head according to the present disclosure has a configuration including a supply manifold configured to define a first circulation channel through which a liquid in the supply manifold circulates, a plurality of descenders that communicate with the supply manifold, and which is configured to guide the liquid from the supply manifold to a plurality of nozzles arranged in a first direction, respectively; and a second circulation channel configured to guide the liquid not discharged from the nozzles to the supply manifold. The second circulation channel includes a return manifold that extends in the first direction to communicate with the plurality of descenders, and a return channel that communicates with an end of the return manifold and communicates with the supply manifold via a return port. A first end, in the first direction, of the first circulation channel in the supply manifold is an outflow port via which the liquid flows out of the supply manifold, and a second end, in the first direction, of the first circulation channel in the supply manifold is an inflow port via which the liquid flows into the supply manifold. In the supply manifold, the return port is closer to the inflow port than to the outflow port.

When the liquid jetting head has such configuration, the liquid jetting head includes the first circulation channel through which the liquid in the supply manifold circulates and the second circulation channel through which the liquid in the vicinity of the nozzles is circulated to (returns to) the supply manifold. A position (return port) where the liquid enters the supply manifold from the second circulation channel is closer to a position (inflow port) where the liquid flowing from an ink cartridge (or ink tank) or the like flows into the supply manifold than to a position (outflow port) where the liquid flows out through the first circulation channel from the supply manifold. In this configuration, liquid circulates so that a circulation direction of liquid in the supply manifold (flowing direction of liquid in the first circulation channel) is opposite to a circulation direction of liquid from the vicinity of the nozzles (flowing direction of liquid in the second circulation channel).

When seeing the entire liquid jetting head, the circulation direction of the first circulation channel is opposite to the circulation direction of the second circulation channel. When seeing the inside of the supply manifold, the direction in which liquid flows through the first circulation channel and the direction in which liquid flows through the second circulation channel is the forward direction (normal direction, same directions). Liquid flowing through the first circulation channel and entering the supply manifold has a relatively low temperature, and liquid flowing through the second circulation channel and entering the supply manifold from the vicinity of the nozzles has a relatively high temperature due to driving heat of the piezoelectric elements. Thus, the circulation flow of liquid having the lower temperature is mixed with the circulation flow of liquid having the high temperature over a relatively long pass in the supply manifold. This homogenizes (uniformizes) the liquid temperature.

In the liquid jetting head having the above configuration, an outflow direction of the liquid in which the liquid circulating through the first circulation channel flows out of the supply manifold via the outflow port may be identical to an inflow direction of the liquid in which the liquid circulating through the second circulation channel flows into the supply manifold via the return port.

In the above configuration, the inflow direction of the liquid from the return port of the second circulation channel and the outflow direction of liquid from the outflow port, of the first circulation channel, apart from the return port are identical to each other. Thus, in the supply manifold, the direction in which liquid flows from the first circulation channel and the direction in which liquid flows from the second circulation channel can be easily regulated in the forward direction (normal direction).

In the liquid jetting head having the above configuration, the outflow port and the inflow port of the first circulation channel may be arranged at both ends in the first direction of the supply manifold, and the return port of the second circulation channel may be positioned to face the inflow port.

In the above configuration, it is possible to lengthen a route along which liquid circulates through the supply manifold by providing the first circulation channel to communicate with the both ends of the supply manifold and providing the return port of the second circulation channel to face the inflow port of the first circulation channel. This homogenizes or uniformizes the liquid temperature.

In the liquid jetting head having the above configuration, the plurality of nozzles may be arranged to form two nozzle rows that are parallel to each other, and the return manifold may communicate with the descenders that communicate with the plurality of nozzles forming the two nozzle rows.

In the above configuration, one return manifold communicates with the two nozzle rows. Thus, there is no need to provide one return manifold for one nozzle row, avoiding a complicated configuration.

In the liquid jetting head having the above configuration, the return manifold may extend in the first direction at a center portion of the liquid jetting head in a second direction orthogonal to the first direction.

In the above configuration, since the return manifold extends along the center portion in the width direction assuming that the first direction is the longitudinal direction, the return manifold can be provided in a stable position. Especially, in the configuration formed having the two nozzle rows, one return manifold can be disposed between the two nozzle rows. The second circulation channel can be thus formed simply.

In the liquid jetting head having the above configuration, provided that a liquid discharge direction from the plurality of nozzles is downward, the return channel may include an upward channel that extends upward from the end of the return manifold and is connected to the supply manifold.

In the above configuration, it is possible to provide the return channel to avoid various components positioned at the upper side of the return manifold by allowing part of the return channel of the second circulation channel as the upward channel to communicate with the supply manifold. This improves the flexibility of a layout of the second circulation channel.

The liquid jetting head having the above configuration may include a protective substrate positioned on a lower side of the supply manifold and an upper side of the return manifold so as to protect a plurality of piezoelectric elements by which the liquid is jetted from the plurality of nozzles, a trace being mounted on the protective substrate. The protective substrate may be positioned at a center portion of the liquid jetting head in a second direction orthogonal to the first direction, and the upward channel may be formed at an outer side in the second direction when seen from the protective substrate.

In the above configuration, since the return channel is disposed in the liquid jetting head at a position where no protective substrate is provided, the second circulation channel can be provided without changing the layout of the protective substrate.

The present disclosure having the above configuration has an effect of providing a liquid jetting head that has a configuration in which liquid can be jetted from nozzles while being circulated and is capable of uniformizing a temperature of liquid in the vicinity of the nozzles satisfactorily.

The present invention is not limited to the embodiment described above, and various changes or modifications may be made without departing from the claims. Embodiments obtained by appropriately combining technical means disclosed in different embodiments and modified examples are also included in the technical scope of the present invention.

The present disclosure is preferably and widely applicable to the field of the liquid jetting head included in the liquid jetting apparatus configured to discharge liquid such as ink.

What is claimed is:

1. A liquid jetting head, comprising:

a supply manifold configured to define a first circulation channel through which a liquid in the supply manifold circulates;

a plurality of descenders that communicate with the supply manifold, and which is configured to guide the liquid from the supply manifold to a plurality of nozzles arranged in a first direction, respectively; and a second circulation channel configured to guide the liquid not discharged from the nozzles to the supply manifold, wherein the second circulation channel includes a return manifold that extends in the first direction to communicate with the plurality of descenders, and a return channel that communicates with an end of the return manifold and communicates with the supply manifold via a return port, a first end, in the first direction, of the first circulation channel in the supply manifold is an outflow port via which the liquid flows out of the supply manifold, and a second end, in the first direction, of the first circulation channel in the supply manifold is an inflow port via which the liquid flows into the supply manifold, and in the supply manifold, the return port is closer to the inflow port than to the outflow port.

2. The liquid jetting head according to claim 1, wherein an outflow direction of the liquid in which the liquid circulating through the first circulation channel flows out of the supply manifold via the outflow port is identical to an inflow direction of the liquid in which the liquid circulating through the second circulation channel flows into the supply manifold via the return port.

3. The liquid jetting head according to claim 1, wherein the outflow port and the inflow port of the first circulation channel are arranged at both ends in the first direction of the supply manifold, and the return port of the second circulation channel is positioned to face the inflow port.

4. The liquid jetting head according to claim 1, wherein the plurality of nozzles is arranged to form two nozzle rows that are parallel to each other, and the return manifold communicates with the descenders that communicate with the plurality of nozzles forming the two nozzle rows.

5. The liquid jetting head according to claim 1, wherein the return manifold extends in the first direction at a center portion of the liquid jetting head in a second direction orthogonal to the first direction.

6. The liquid jetting head according to claim 1, wherein provided that a liquid discharge direction from the plurality of nozzles is downward, the return channel includes an upward channel that extends upward from the end of the return manifold and is connected to the supply manifold.

7. The liquid jetting head according to claim 6, further comprising a protective substrate positioned on a lower side of the supply manifold and an upper side of the return manifold so as to protect a plurality of piezoelectric elements by which the liquid is jetted from the plurality of nozzles, a trace being mounted on the protective substrate, wherein the protective substrate is positioned at a center portion of the liquid jetting head in a second direction orthogonal to the first direction, and the upward channel is formed at an outer side in the second direction when seen from the protective substrate.

* * * * *